US011473376B2

(12) United States Patent
Banks et al.

(10) Patent No.: US 11,473,376 B2
(45) Date of Patent: Oct. 18, 2022

(54) NON-ROTATING VIBRATION REDUCTION SUB

(71) Applicant: WWW North America Holdings, Inc., Houston, TX (US)

(72) Inventors: Sarah Banks, Fullerton, CA (US); Norman Bruce Moore, Aliso Viejo, CA (US); Eric Gollmyer, Orange, CA (US)

(73) Assignee: WWT NORTH AMERICA HOLDINGS, INC, Houston, TX (US)

( * ) Notice: Subject to any disclaimer, the term of this patent is extended or adjusted under 35 U.S.C. 154(b) by 55 days.

(21) Appl. No.: 16/285,638

(22) Filed: Feb. 26, 2019

(65) Prior Publication Data

US 2019/0284883 A1 Sep. 19, 2019

Related U.S. Application Data

(60) Provisional application No. 62/643,885, filed on Mar. 16, 2018.

(51) Int. Cl.
*E21B 17/10* (2006.01)

(52) U.S. Cl.
CPC ..... *E21B 17/1042* (2013.01)

(58) Field of Classification Search
CPC ..... E21B 17/007; E21B 17/1014; E21B 17/1042; E21B 17/1078; E21B 17/16; E21B 17/1085; E21B 17/12
USPC ..... 166/242.1; 175/325.5
See application file for complete search history.

(56) References Cited

U.S. PATENT DOCUMENTS 1,764,769 A * 6/1930 Woods ..... E21B 17/1064 175/325.3
2,572,307 A * 10/1951 Brown ..... E21B 17/1064 175/325.3
2,589,534 A * 3/1952 Buttolph ..... E21B 17/1078 175/306
2,715,552 A * 8/1955 Lane ..... E21B 17/1042 175/325.5
3,063,760 A * 11/1962 Gifford ..... E21B 17/1042 175/325.5

(Continued)

FOREIGN PATENT DOCUMENTS

CA 2330963 A1 * 11/1999 ..... E21B 17/22
CA 3020756 A1 * 10/2017 ..... E21B 17/1042

(Continued)

OTHER PUBLICATIONS

Schlumberger, "Sub", undated, https://glossary.oilfield.slb.eom/en/terms/s/sub, 2 pages (Year: 2021).*

(Continued)

*Primary Examiner* — Jennifer H Gay
(74) *Attorney, Agent, or Firm* — Lewis Roca Rothgerber Christie LLP

(57) ABSTRACT

An anti-vibration sub for a downhole drill string having a shortened section of steel drill pipe having a reduced diameter body portion with a plurality of axially spaced annular rings and a non-rotating protector sleeve molded to the smaller diameter body portion having an outside diameter that is equal to or greater than the drill string causing the sub to act as a nodal point to absorb vibrational energy from the drill string.

11 Claims, 3 Drawing Sheets

(56) References Cited

U.S. PATENT DOCUMENTS 3,193,918 A * 7/1965 Heldenbrand ..... E21B 17/12 228/182
3,268,275 A * 8/1966 Laghlin ..... E21B 17/1042 175/325.2
3,322,217 A * 5/1967 Orr ..... E21B 17/1078 175/323
3,747,700 A * 7/1973 Rilling ..... E21B 17/1078 175/227
3,784,238 A * 1/1974 Chance ..... E21B 17/16 285/288.1
4,146,060 A * 3/1979 Garrett ..... B23P 11/00 138/143
4,434,125 A * 2/1984 Lavender ..... B29C 39/10 264/262
4,762,186 A * 8/1988 Dech ..... E21B 7/06 175/61
4,938,299 A * 7/1990 Jelsma ..... E21B 7/06 175/73
5,148,876 A * 9/1992 Wilson ..... E21B 7/04 175/325.3
5,697,460 A * 12/1997 Stewart ..... E21B 17/1078 175/325.5
5,901,798 A 5/1999 Herrera et al.
5,941,312 A * 8/1999 Vermeeren ..... E21B 17/1071 166/241.2
6,012,744 A * 1/2000 Wilson ..... E21B 17/16 285/288.1
6,032,748 A * 3/2000 DeBray ..... E21B 17/105 166/241.4
6,655,477 B2 * 12/2003 Appleton ..... E21B 17/1085 175/325.3
7,392,861 B2 * 7/2008 Fouillou ..... E21B 47/01 175/325.1
7,409,758 B2 * 8/2008 Le ..... E21B 17/1007 29/421.1
7,412,761 B2 * 8/2008 Male ..... B29C 33/00 138/153
7,814,996 B2 * 10/2010 Indrupskiy ..... E21B 17/1064 175/323
8,119,047 B2 2/2012 Moore et al.
8,511,377 B2 * 8/2013 Casassa ..... E21B 17/1042 166/241.6
8,668,007 B2 * 3/2014 Casassa ..... E21B 17/1042 166/241.6
9,328,568 B2 * 5/2016 Andrigo ..... E21B 17/1042
10,619,427 B2 * 4/2020 Gaskins ..... E21B 43/127
2003/0106719 A1 * 6/2003 Herrera ..... E21B 17/1057 175/325.2
2008/0217063 A1 9/2008 Moore et al.
2009/0183869 A1 * 7/2009 Davison ..... E21B 17/1071 166/241.3
2011/0114307 A1 * 5/2011 Casassa ..... E21B 17/1042 166/241.1
2011/0114338 A1 * 5/2011 Casassa ..... E21B 17/1078 166/382
2014/0151026 A1 * 6/2014 Andrigo ..... E21B 17/1042 166/241.6
2017/0275956 A1 * 9/2017 Palmer ..... E21B 17/1085
2018/0112472 A1 * 4/2018 Gaskins ..... E21B 17/1078
2019/0284883 A1 * 9/2019 Banks ..... E21B 17/1042
2020/0165881 A1 * 5/2020 Nommensen ..... E21B 17/1078

FOREIGN PATENT DOCUMENTS

CA 3035407 A1 * 9/2019 ..... E21B 17/1078
CN 2378530 Y 5/2000
CN 204984297 U 1/2016
DE 497705 C * 5/1930 ..... E21B 17/1042
GB 2338970 A * 1/2000 ..... E21B 17/1064
WO WO-2015026243 A2 * 2/2015 ..... E21B 17/1078

OTHER PUBLICATIONS

First Office action issued in parallel Canadian Patent Application No. 3,035,407, dated Jul. 14, 2020, 4 pages.
Canadian Office action for Application No. 3,035,407, dated Jan. 28, 2022, 11 pages.

* cited by examiner

NON-ROTATING VIBRATION REDUCTION SUB

CROSS-REFERENCE TO RELATED APPLICATION(S)

This application claims priority to and the benefit of U.S. Provisional Application No. 62/643,885, filed Mar. 16, 2018, the contents of which are incorporated herein by reference.

BACKGROUND OF THE INVENTION

A persistent issue with rotary drilling is drill string vibration. Consequences of excessive vibration are reduced rate of penetration (ROP) and damage to drill string components, such as rotary steerable tools or drill bits, resulting in pulling out of the hole to replace worn or damaged parts.

Types of drilling string modes include stick slip (torsional) mode; whirl (lateral vibration) mode; and bit bounce (axial) mode (all relative to the drill string axis). It is also common that one or more of the modes defined occur simultaneously while drilling. Various methods are used to measure the resulting acceleration from vibration with down hole tools that have recorded accelerations of 3-18 g's (times acceleration due to gravity).

To lessen the effects of drill string vibration, many operational and equipment options have been used. For example, an operational change when stick slip occurs is to reduce the weight on bit (WOB). When whirl occurs, an operational change is to reduce WOB and or increase revolutions per minute (RPM). The changes in operational parameters are typically done on the surface by the Auto Driller of the top drive system. However, because of the lack of real time down hole information, damage to drilling equipment can occur before the surface equipment can respond.

There is a long history of various types of downhole anti-vibration equipment that has been tried with varying success. Early efforts used a combination of springs and dampening members (typically rubber) to reduce axial bit bounce, however these devices did little to affect lateral vibrations, were expensive to operate and refurbish, and failure downhole frequently required a trip to the surface. More recent efforts used sensors to control the activation of magneto-resistive fluids to control vibration; this approach was prohibitively expensive and unreliable.

Another significant disadvantage of the use of larger devices (greater than 20 ft.) as anti-vibration equipment is placement in the drill string for effectiveness. Placement of multiple large devices becomes problematic with handling of the drill string.

Another recent development to improve drilling is the use of software to perform a vibrational analysis on the bottom hole assembly (BHA) to determine the vibrational frequencies that induce the greatest potential damage to the equipment. Infrequently, a vibrational analysis is performed on the drill string, less the BHA. These analyses are typically performed to evaluate the effects of buckling-induced vibration. The current state of the art software does not allow one analysis to evaluate both the drill string and BHA simultaneously. This results in omission of interaction of BHA vibration and drill string buckling-induced vibration.

Previously Applicant developed a mold-in-place method of producing a non-rotating solid body stabilizer or non-rotating solid body protector sub as disclosed in U.S. Pat. No. 8,119,047. The inner surface of the molded protector sleeve could be shaped to form a fluid bearing during use.

Fixed stop collars may also be molded in situ in the same mold and bonded to the tubing at opposing ends of the molded sleeve. Alternatively, a flexible sleeve liner made from a material having a hardness less than that of the sleeve's molding material could be used as a mold insert around the tubing. The liner could be bonded to the molded sleeve material when the sleeve was molded around the liner. The interior surface of the liner could be shaped to form a fluid bearing for the inside surface of the molded sleeve. Reinforcing inserts and wear pads could be placed in the mold region of the sleeve. Chemical and/or mechanical bonding is provided between the liner reinforcement and the material from which the sleeve is molded. Reinforcing inserts and wear pads also could be placed in the mold regions for the stop collars. This protector sub addressed the reduction of drilling torque but did not consider the effects of vibration.

Consequently, what is needed is an anti-vibration tool that can judiciously be placed close to the BHA or further uphole on the drill string cooperatively working with an Autodriller system, thereby treating the vibration problem as a systems issue. What also is needed is an anti-vibration device that is effective in reducing vibration in multiple modes, is low cost, reliable, easy to surface, does not result in a forced trip out of hole, can be placed at multiple appropriate locations on the drill string to reduce system vibration, and does not affect the Autodriller functions.

SUMMARY OF THE INVENTION

The present invention is directed to an anti-vibration sub and addresses the vibration-related problems defined above in an innovative design.

The anti-vibration sub is a non-rotating protector sleeve that is molded in place around a single piece of a shortened section of steel drill pipe or specially modified or fabricated joint of drill pipe, with the drill pipe having one or more annular rings integral to a body section that prevents axial movement of the sleeve, and functions to transmit thrust loads to a mandrel section. The formation and characteristics of the sleeve can be as disclosed in Applicant's U.S. Pat. No. 8,119,047, the disclosure of which is incorporated herein by reference. The steel drill pipe may be of varying lengths, but typically less than 10 feet, such as 6 feet. The ends of the sub have standard API threaded connections that have industry known fatigue life properties. There are no threaded joints internal to the sub, thereby reducing the potential for failure of threaded joints within the sub. The sub is sized to be consistent with standard drill pipe nominal sizes from 3½ inches to 6⅝ inches in diameter. The mechanical properties of the sub are the same as typical API drill pipe to which is it a member. The axially spaced annular rings can be on the outside of the sleeve or internal to the sleeve. The protector sleeve can included multiple grooves to increase surface area to reduce stress and increase heat/energy dissipation from vibration.

DETAILED DESCRIPTION

Figure 1:
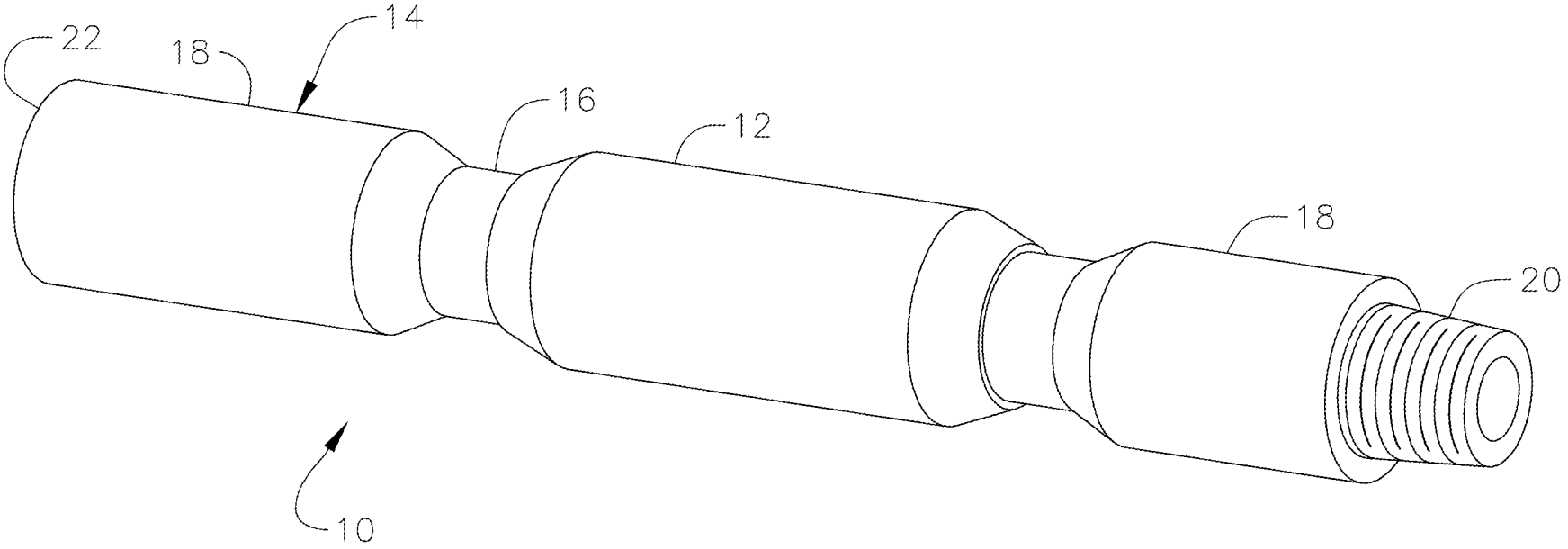
FIG. 1 is a perspective view of the anti-vibration sub of the present invention.
Figure 2:
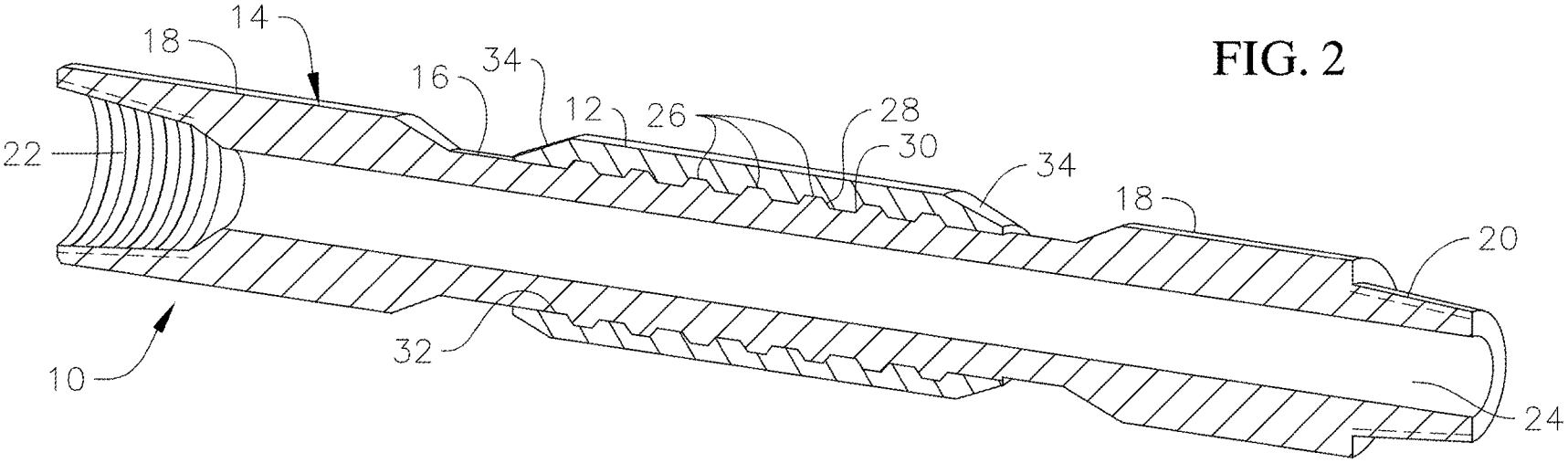
FIG. 2 is a cross-sectional view of the sub of FIG. 1.

Referring to FIGS. 1 and 2, an anti-vibration sub 10 of the present invention is illustrated. The anti-vibration sub comprises a non-rotating protector sleeve 12 that is molded in place around a single piece of a shortened section of steel drill pipe 14 or specially modified or fabricated joint of a drill pipe having a reduced diameter body section 16 positioned between outer mandrel sections 18. The ends of the sub have standard API threaded connections comprising a male connector 20 at one end and a female connector 22 at an opposite end. The sub is substantially cylindrical having an axial bore 24 extending the length of the sub. The body section 16 includes a plurality of annular rings 26 integrally formed and extending axially outwardly from the body section. The non-rotating protector sleeve is molded in place on the body section over the annular rings which prevents axial movement of the sleeve. The annular rings and the body section function to transmit thrust loads to the mandrel section of the sub. The sub may be of varying lengths but typically less than 10 feet, and more particularly 6 feet for example. The sub is sized to be consistent with standard drill pipe nominal sizes from 3½ inches to 6⅝ inches in diameter. The sub is placed within the drill string by being connected to drill pipe on either end of the sub. The mechanical properties of the sub are the same as typical API drill pipe to which it is a member.

Typically the sub will have 3 to 7 annular rings along the body section to distribute large axial loads encountered while drilling. The rings 26 are relatively thin and are approximately five to twenty-five percent of the nominal diameter of the sub to allow for bending in the sub without large stress concentrations. The rings 26 have angled side surfaces 28 to minimize stress discontinuity and to prevent a wedge effect that forces the sleeve around the rings. The angle of the side surfaces 28 may range from forty-five to seventy-five degrees relative to the central axis of the sub and have a radius 30 at the root of the rings that is ten to fifty percent of the height of the rings. The interaction between the rings on the sub and the sleeve results in dissipation of energy from all three modes of vibration, namely axial, torsional and lateral vibration. The axial rings typically are buried within the sleeve as shown in FIG. 2, however, can extend to the outside surface of the sleeve.

The non-rotating sleeve has an internal diameter fluid bearing surface geometry 32 created by having a plurality of flat surfaces separated by axial grooves as disclosed in U.S. Pat. No. 8,119,047. The internal diameter fluid bearing geometry is created using a mold containing a removable or dissolvable internal form. The sleeve can be cast, molded or 3-D printed with a fluid bearing ID geometry made from a water-soluble material such as PVA (polyvinyl alcohol) or BVOH (butenediol vinyl alcohol co-polymer). High-impact polystyrene may also be used, and dissolved in an organic solvent. Alternatively, a material can be used as an internal form that has a lower melting point than the molded body of the non-rotating sleeve. The sleeve may contain a structural, hard outer layer with a soft (50-95A shore hardness) elastomeric inner layer. The inner soft layer improves the performance and load capacity of the fluid bearing, but also increases the axial and lateral vibration reduction characteristics of the sleeve. The sleeve may also be cast from a hard urethane (95A-75D shore hardness), with a thin (0.050-0.250 inch) layer of softer urethane (75A-95A hardness) applied to the inside diameter of the sleeve prior to molding. The sleeve is made from a material that resist external damage during drilling, but if it is torn off the sub it is to be drillable or preferably will float to the surface.

The sleeve may also include a cage or fiber reinforcement to provide additional hoop and axial strength if desired. The sleeve is designed to be sacrificial and can be removed from the body section and a new sleeve molded to provide a new sacrificial sleeve for each new drilling condition. The sleeve diameter is sized to be the same or larger than the drill pipe and the drill string. The diameter restricts the range of motion of the sub and hence the drill string. As shown in FIG. 2, the external shape of the sleeve includes a smooth outer surface and is substantially cylindrical with tapered ends 34 to prevent hang ups on surfaces downhole during the drilling process.

Other materials may also be used to mold the sleeve, for example, the sleeve may be molded with a thin (0.050-0.250 inch) rubber layer, such as NBR or HNBR or a urethane layer with glass or an aramid, such as Kevlar, reinforced epoxy or vinyl ester resin composite molded around the outside diameter to form the main structural portion of the sleeve. Low friction additives such as UHMWPE or PTFE, may be included in either the urethane or composite material to reduce friction and enhance wear resistance. It is to be understood that the construction is dependent on well conditions and can include for an inner layer or a solid molded part made from plastic or elastomer dampener material such as Ultra High Molecular Weight Polyethylene, Nylon, Polyetherimide, Urethane or Rubber. In configurations where the sleeve includes a molded composite shell, the materials can include Kevlar, Carbon, Glass, Basalt or a combination of these materials to provide the necessary strength and wear protection. The ID geometry of the sleeve in combination with the body portion of the sub interface to dissipate energy and heat from the vibration induced movement.

The method of molding the protector sleeve would include coating the body portion of the sub with a mold release, wax silicone or an equivalent and then wrapping the contact surface of the sub in UHMW tape approximately 0.030 inches thick then casting the sleeve material around the body section and tape. For a urethane material it could be filled with aluminum or a similar material to help with heat transfer. The inside diameter geometry of the sleeve to create a fluid bearing is created during the molding process. Other method steps can include wrapping the contact surface of the sub in an uncured rubber, approximately 0.100 inches thick and wrapping over the rubber with Kevlar reinforced epoxy or vinyl ester composite. The composite can be filled with aluminum pigment or similar material to help with heat transfer. After the rubber and epoxy are cured, spiral or axial grooves can be machined into the outside of the protector sleeve for drilling fluid flow. The protector could also be formed by molding an ultra high molecular weight solid body around the body section. The molding process could include the axial grooves for a fluid bearing or exterior grooves for fluid flow. Alternatively, the protector sleeve could be manufactured with a 3-D printed HIPS high temperature or ultra high molecular weight shell over the body section. The HIPS shell would dissolve in mild solvent leaving a method for creating a lost wax fluid bearing. The ultra high molecular weight shell could at first provide low friction, but wear away to provide space for the fluid bearing. The shell could provide a larger fluid space and molded in channels could provide a pathway for fluid to enter and leave the sub. A sub incorporating a shell could also allow axial space in the grooves for drilling fluid to squeeze in and out providing more effective cooling.

Figure 3:
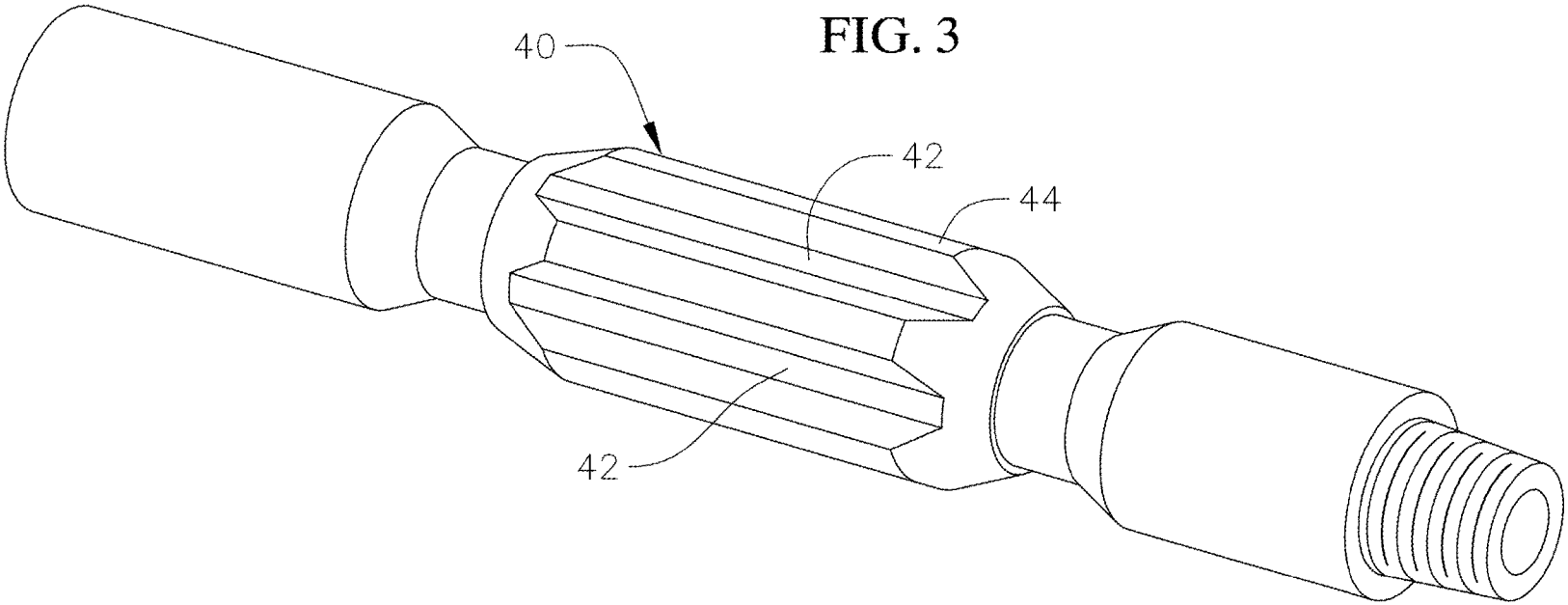
FIG. 3 is a perspective view of an alternative embodiment anti-vibration sub of the present invention.
Figure 4:
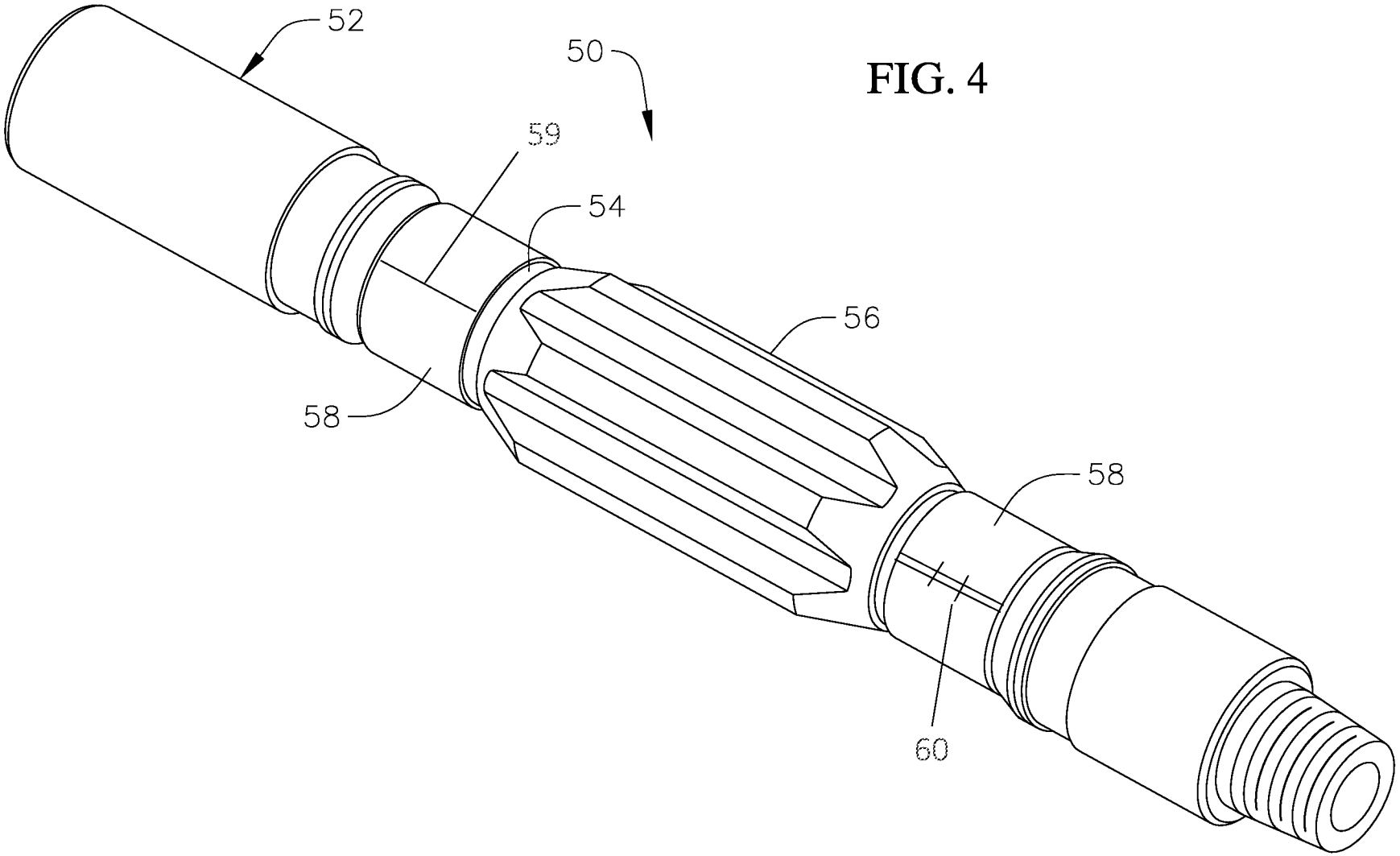
FIG. 4 is a perspective view of a second alternative embodiment anti-vibration sub of the present invention.

As shown in FIG. 3 an alternative protector sleeve 40 is illustrated which includes multiple grooves 42 in the outer surface to increase surface area to reduce stress and increase heat and energy dissipation caused from vibration. Grooves 42 or flutes can be straight or spiral shaped to facilitate downward motion during use. Further, flat surfaces 44 can be incorporated on the external surface of the sleeve to inhibit any partial rotation of the sleeve during downhole movement. All sleeve configurations are designed not to restrict flow.

As shown in FIG. 5 an anti-vibration sub 50 can incorporate a shortened section of steel drill pipe 52 having a smaller diameter body portion 54 for receipt of the protector sleeve 56 which is held in place on the body portion 54 by stop collars 58 positioned on either side of the sleeve 56. In this embodiment, the body portion would not include annular rings to prevent axial movement of the sleeve which is retained axially by the stop collars. In this embodiment, the stop collars are positioned on either side of the sleeve once it is molded. The stop collars could be hinged 59 and fastened with mechanical fasteners 60 or can be welded in place. The stop collars also help absorb axial loads but do not impede bending of the sub. An embodiment incorporating stop collars helps reduce bending stress concentration and increases fatigue life of the sub. Stop collars also allow for the use of a larger bearing surface and allows transfer of axial loads without creating hoop stress in the sleeve. Incorporating stop collars also provides for the ability to incorporate sleeves with traditional fluid bearing internal diameter configurations.

In use the anti-vibration subs are placed in strategic locations along the drill string. The number of subs can range from 1-50, but most commonly is 4-5 subs depending upon the well requirements. The anti-vibration subs are placed at strategic locations to specifically dampen vibration wherein the location of the subs will be determined by numerical methods of iteratively evaluating design with the subs placed in locations of highest predicted vibration amplitude. The numerical analysis will consider both bottom hole assembly and upper drill string requirements. Placement of the subs considers drill string buckling in the upper drill string as well as predicted vibration frequencies for the bottom hole assembly. Commercially available modeling methods are available including the Stick-Slip Module of WellScan software of DrillScan which allows prediction of the primary and secondary vibration modes of bottom hole assembly. Pegasus Vertex's TADPRO can predict regions of drill string buckling. These modeling methods allow for placement of the anti-vibration subs near the bottom hold assembly and in the drill string.

The anti-vibration sub reduces drill string vibration by transmitting vibrational energy from the drill string to a steel body of a sub, to ribs on the steel body, to a drillable molded-in-place replaceable sleeve. The sub reduces drill string vibration and utilizes drilling fluid to form a fluid bearing that reduces drilling torque and assists the heat dissipation in the sleeve resulting from vibrational energy absorption. The anti-vibration sub is placed strategically along the drilling string typically at anti-nodal points and in regions of the drill string buckling and at least one near or in the bottom hole assembly to reduce drill string vibration in one or more vibration modes. The protector sleeve is made with various materials having a soft inner surface adjacent the annular rings on the body portion and a harder wear resistant external surface. The anti-vibration sub reduces drill string vibration with having an outside diameter that is equal to or larger than adjacent drill pipe thereby acting as a nodal point to absorb vibrational energy from the drill string.

The present invention has been described and illustrated with respect to several embodiments thereof, however it is to be understood that changes and modifications can be made therein which are within the full intended scope of the invention as hereinafter claimed.

What is claimed is:

1. An anti-vibration sub for placement between and attachment to an end of adjacent individual drill pipe segments which rotate during drilling and have a drill pipe segment length within a downhole drill string, the downhole drill string further having a bottom hole assembly, the anti-vibration sub comprising:

a cylindrical steel pipe having an outside diameter and an anti-vibration sub length shorter than the drill pipe segment length and less than 10 feet, the cylindrical steel pipe comprising:

a first mandrel section at a first end of the cylindrical steel pipe;

a second mandrel section at a second end of the cylindrical steel pipe; and a body portion located between the first and second mandrel sections, the body portion having an outside diameter smaller than the outside diameter of the cylindrical steel pipe and a plurality of axially spaced annular rings extending outwardly from the outside diameter of the body portion, wherein the plurality of annular rings and the body portion are formed of the same piece, and wherein the plurality of annular rings are configured to transmit axial thrust loads generated by the bottom hole assembly while drilling, the axial thrust loads being transmitted through the annular rings and the body portion to the first and second mandrel sections; and a vibration absorbing non-rotating protector sleeve molded to the body portion and engaging the axially spaced annular rings and having an inner soft layer having an internal diameter fluid bearing surface geometry to provide lubrication between the non-rotating protector sleeve when the non-rotating protector sleeve is not rotating and the annular rings are rotating;

wherein the cylindrical steel pipe has threaded connectors on either end for attachment to the end of the adjacent individual drill pipe segments adjacent to or part of the bottom hole assembly within the drill string;

wherein an outside diameter of the protector sleeve is equal to or larger than an outside diameter of the drill string thereby causing the anti-vibration sub to act as a nodal point and absorb vibrational energy generated from the bottom hole assembly in the drill string; and wherein the annular rings solely retain the non-rotating protector sleeve to the body portion and are sized to allow bending of the cylindrical steel pipe without large stress concentrations and prevent discontinuity between the non-rotating protector sleeve and the annular rings, wherein interaction between the annular rings and the non-rotating protector sleeve dissipates axial, torsional and lateral vibration generated by the bottom hole assembly.

2. The sub of claim 1, wherein the plurality of axially spaced annular rings are between three to seven.

3. The sub of claim 1, wherein the protector sleeve is positioned over the annular rings.

4. The sub of claim 1, wherein the protector sleeve has a hard outer layer around the inner soft layer.

5. The sub of claim 1, wherein the protector sleeve includes grooves in an outer surface.

6. The sub of claim 5 wherein the grooves are straight.

7. The sub of claim 1, wherein the protector sleeve is molded from a material selected from a group consisting of one or more of urethane, rubber, glass or aramid fiber, epoxy or vinyl ester resin or combinations thereof.

8. The sub of claim 1, wherein the anti-vibration sub is positioned along drill string buckling locations of the drill string.

9. The sub of claim 1, wherein the annular rings are between 5 percent to 25 percent of a nominal diameter of the anti-vibration sub.

10. The sub of claim 1, wherein the annular rings have angled side surfaces.

11. The sub of claim 10, wherein the angled side surfaces range from 45 degrees to 75 degrees relative to a central axis of the anti-vibration sub and have a radius at a root of the annular rings that is 10 percent to 50 percent of a height of the rings.

* * * * *